US005163202A

United States Patent [19]

Kawakami et al.

[11] Patent Number: 5,163,202

[45] Date of Patent: Nov. 17, 1992

[54] DUST DETECTOR FOR VACUUM CLEANER

[75] Inventors: Hiroshi Kawakami; Shuji Asada; Sadahiro Shimada, all of Youkaichi; Mitsuo Ishii, Shiga, all of Japan

[73] Assignee: Matsushita Electric Industrial Co. Ltd., Kadoma, Japan

[21] Appl. No.: 746,799

[22] Filed: Aug. 14, 1991

Related U.S. Application Data

[63] Continuation of Ser. No. 365,734, Jun. 14, 1989, abandoned.

[30] Foreign Application Priority Data

| | | | |
|---|---|---|---|
| Mar. 24, 1988 | [JP] | Japan | 63-210265 |
| Jun. 15, 1988 | [JP] | Japan | 63-147430 |
| Jun. 15, 1988 | [JP] | Japan | 63-147471 |
| Jun. 27, 1988 | [JP] | Japan | 63-158549 |

[51] Int. Cl.[5] ..... A47L 9/28

[52] U.S. Cl. ..... 15/319; 15/339; 250/574; 356/72; 356/438

[58] Field of Search ..... 15/319, 339; 250/239, 250/573, 574; 356/438, 439, 72; 357/17, 72-74

[56] References Cited

U.S. PATENT DOCUMENTS

| | | | |
|---|---|---|---|
| 2,565,716 | 8/1951 | Boyce | 250/239 X |
| 2,839,646 | 6/1958 | Hester | 250/239 X |
| 2,918,585 | 12/1959 | Farmer | 250/239 |
| 3,448,406 | 6/1969 | McClure . | |
| 3,483,507 | 12/1969 | Griswold | 250/239 X |
| 3,536,831 | 10/1970 | Kanemaki et al. | 250/239 X |
| 3,814,935 | 6/1974 | Kissel | 250/573 X |
| 3,816,004 | 6/1974 | Bignardi | 356/438 |
| 3,861,802 | 1/1975 | Belmear, Jr. | 250/573 |
| 3,870,878 | 3/1975 | Walter et al. | 250/239 |
| 4,021,120 | 5/1977 | Muller et al. | 250/573 |
| 4,394,572 | 7/1983 | Wilber | 250/239 |
| 4,580,311 | 4/1986 | Kurz | 356/438 X |
| 4,586,996 | 5/1986 | Shinohara et al. | 351/166 X |
| 4,601,082 | 7/1986 | Kurz | 15/319 |
| 4,680,827 | 7/1987 | Hummel | 15/319 |
| 4,728,801 | 3/1988 | O'Connor | 250/573 |
| 4,748,336 | 5/1988 | Fujie et al. | 250/573 |
| 4,767,213 | 8/1988 | Hummel | 356/439 X |
| 4,769,535 | 9/1988 | Sasaki et al. | 250/239 X |
| 4,841,144 | 6/1989 | Goi et al. | 250/239 |
| 4,920,605 | 5/1990 | Takashima | 15/319 |
| 4,937,912 | 7/1990 | Kurz | 15/339 |
| 4,942,640 | 7/1990 | Hayashi et al. | 15/319 |

FOREIGN PATENT DOCUMENTS

| | | | |
|---|---|---|---|
| 0312111 | 4/1989 | European Pat. Off. | 15/319 |
| 2900433 | 6/1980 | Fed. Rep. of Germany | 15/339 |
| 3534621 | 4/1987 | Fed. Rep. of Germany | 15/339 |
| 2197555 | 3/1974 | France . | |
| 212737 | 12/1984 | Japan | 356/438 |
| 196140 | 8/1986 | Japan | 356/438 |
| 87828 | 4/1987 | Japan | 356/438 |
| 307641 | 12/1989 | Japan | 356/439 |
| 559500 | 2/1975 | Switzerland | 250/239 |

*Primary Examiner*—Philip R. Coe
*Assistant Examiner*—C. Cooley
*Attorney, Agent, or Firm*—Cushman, Darby & Cushman

[57] ABSTRACT

A dust detector in a vacuum cleaner includes a light-emitting element exposed into a dust suction passage for emitting a light beam into the dust passage, and a light-detecting element exposed into the dust suction passage for detecting the light beam emitted from the light-emitting element. A detector unit detects the amount of dust flowing through the dust suction passage based on the intensity of the light beam transmitted from the light-emitting element across the dust suction passage to the light-detecting element. The light-emitting element and the light-detecting element are covered respectively by a pair of light-transmissive covers having respective end faces exposed into the dust suction passage and lying flush with an inner wall surface of the dust suction passage.

7 Claims, 6 Drawing Sheets

DUST DETECTOR FOR VACUUM CLEANER

This is a continuation of application Ser. No. 07/365,734, filed on Jun. 14, 1989, which was abandoned.

BACKGROUND OF THE INVENTION

1. Field of the Invention

The present invention relates to a dust detector for optically detecting the quantity of dust flowing through a suction passage in a vacuum cleaner and controlling the rotational speed of the fan motor, for example, based on the detected quantity of dust.

2. Prior Art

Various dust detectors have heretofore been proposed for optically detecting the quantity- of dust flowing through suction passages in vacuum cleaners. One known typical dust detector is disclosed in U.S. Pat. No. 4,601,082.

The disclosed dust detector comprises an optical sensor including a light transmitter and a light receiver. Light is emitted by the light transmitter into the suction passage toward the light receiver. The intensity of light detected by the light receiver is varied depending on how much light is cut off or reflected by dust particles flowing through the suction passage. The quantity of dust passing through the suction passage is indirectly detected from a variation in the output signal from the light receiver. The rotational speed of the fan motor of the vacuum cleaner or a cleanliness indicator on the vacuum cleaner is controlled based on the detected amount of dust.

More specifically, if the quantity of dust particles flowing through the suction passage is large, the rotational speed of the fan motor is increased for creating greater suction power. The condition indicating a large quantity of dust flowing through the suction passage, i.e., when a surface has not yet been cleaned up, and the condition indicating a small quantity of dust flowing through the suction passage, i.e., when a surface has almost been cleaned up, are indicated respectively by differently colored lamps to allow the user of the vacuum cleaner to clean desired surfaces efficiently.

The light transmitter and the light receiver of the optical sensor are positioned such that they are exposed into the suction passage through which dust flows. During usage of the vacuum cleaner, therefore, dust particles tend to be attached to the exposed surfaces of the light transmitter and the light receiver, through which light is emitted and detected, resulting in poor performance of the optical sensor. This problem has prevented vacuum cleaners with optical dust detectors from finding practical use.

SUMMARY OF THE INVENTION

In view of the aforesaid drawbacks of the conventional dust detectors for vacuum cleaners, it is an object of the present invention to provide a dust detector which comprises sensor having a light-emitting element and a light-detecting element that are arranged to prevent dust particles from being attached to their light-emitting and -detecting surfaces for maintaining good sensor performance over a long period of time.

Another object of the present invention is to provide a dust detector which comprises a sensor having a light-emitting element and a light-detecting element that are covered with light-transmissive covers, respectively, having end surfaces exposed into a suction passage and lying flush with inner wall surfaces of the suction passage to smooth a flow of dust-laden air through the suction passage, thereby preventing dust particles from being attached to the end surfaces of the light-transmissive covers.

Still another object of the present invention is to provide a dust detector comprising a sensor having a light-emitting element and a light-detecting element that are covered with light-transmissive covers, respectively, the light-transmissive cover which covers the light-emitting element having a light-emitting end of a reduced diameter for emitting a constant-diameter light beam without light dispersion to permit reliable dust detection.

Yet another object of the present invention is to provide a dust detector which comprises a sensor having a light-emitting element and a light-detecting element that are covered with light-transmissive covers, respectively, having exposed end faces hardened for protection against damage by dust particles A further object of the present invention is to provide a dust detector comprising a sensor positioned near the terminal end of a downstream constricted portion of a vacuum cleaner suction passage, so that dust particles as they pass through the suction passage will flow in spaced relation to the sensor due to inertia.

A still further object of the present invention is to provide a dust detector which comprises a sensor having a light-emitting element and a light-detecting element, and means for introducing ambient air along the light-emitting and -detecting elements depending on the pressure in a vacuum cleaner suction passage, to clean the light-emitting and -detecting elements.

A yet further object of the present invention is to provide a dust detector which comprises a sensor having a light-emitting element and a light-detecting element that are less susceptible to extraneous light for increasing the accuracy of the sensor in operation.

According to the present invention, a dust detector in a vacuum cleaner, comprising a dust suction passage for passage of dust therethrough, a light-emitting element exposed into the dust suction passage for emitting a light beam into the dust passage, a light-detecting element exposed into the dust suction passage for detecting the light beam emitted from the light-emitting element, a detector unit for detecting the amount of dust flowing through the dust suction passage based on the intensity of the light beam transmitted from the light-emitting element across the dust suction passage to the light-detecting element, and a pair of light-transmissive covers covering the light-emitting element and the light-detecting elements, respectively, and having respective end faces exposed into the dust suction passage and lying flush with an inner wall surface of the dust suction passage.

According to the present invention, there is also provided a dust detector in a vacuum cleaner, comprising a dust suction passage for passage of dust therethrough in a direction, a light-emitting element for emitting a light beam into the dust passage, a light-detecting element for detecting the light beam emitted from the light-emitting element, and a detector unit for detecting the amount of dust flowing through the dust suction passage based on an output signal from the light-detecting element, the dust suction passage having an inner taper surface having a smaller diameter at a downstream end with respect to the direction, the light-emitting element and the light-detecting element being positioned near the downstream end of the inner taper surface.

According to the present invention, there is also provided a dust detector in a vacuum cleaner, comprising a dust suction passage for passage of dust therethrough, a dust sensor disposed in the dust suction passage and comprising a light-emitting element and a light-detecting element, the dust sensor including means for detecting the quantity of dust flowing through the dust suction passage based on the intensity of light transmitted from the light-emitting element across the dust suction passage to the light-detecting element, a pair of air passages in which the light-emitting element and the light-detecting elements are disposed, respectively, each of the air passages having one end vented to atmosphere and the other end opening into the dust suction passage, and a pair of pressure-responsive valves disposed in the air passages, respectively, for selectively opening and closing the air passages depending on a pressure in the dust suction passage.

According to the present invention, there is further provided a dust detector in a vacuum cleaner, comprising a dust suction passage for passage of dust therethrough in a direction, a dust sensor comprising a light-emitting element and a light-detecting element, the dust suction passage being positioned between the light-emitting element and the light-detecting element, the dust sensor including means for detecting the quantity of dust flowing through the dust suction passage based on the intensity of light transmitted from the light-emitting element across the dust suction passage to the light-detecting element, the light-detecting element having an axis inclined with respect to the direction, and a pair of light-transmissive covers covering the light-emitting element and the light-detecting element, respectively.

According to the present invention, there is further provided a dust detector in a vacuum cleaner, comprising a dust suction passage for passage of dust therethrough, and a dust sensor disposed in the dust suction passage and comprising a light-emitting element and a light-detecting element, the dust sensor including means for detecting the quantity of dust flowing through the dust suction passage based on the intensity of light transmitted from the light-emitting element across the dust suction passage to the light-detecting element, the dust suction passage being defined by a wall including portions near the light-emitting element and the light-detecting element, the portions being of a black or dark color.

According to the present invention, there is also provided a dust detector in a vacuum cleaner, comprising a dust suction passage for passage of dust therethrough, and a dust sensor disposed in the dust suction passage and comprising a light-emitting element and a light-detecting element, the dust sensor including means for detecting the quantity of dust flowing through the dust suction passage based on the intensity of light transmitted from the light-emitting element across the dust suction passage to the light-detecting element, the dust suction passage being defined by a wall including portions near the light-emitting element and the light-detecting element, the portions being molded of of a synthetic resin containing an infrared radiation absorbent.

According to the present invention, there is further provided a dust detector in a vacuum cleaner, comprising a main vacuum cleaner unit having a suction inlet, a handle defining therein a dust suction passage for passage of dust therethrough, a light-emitting element for emitting a light beam into the dust passage, a light-detecting element for detecting the light beam emitted from the light-emitting element, a detector unit for detecting the amount of dust flowing through the dust suction passage based on an output signal from the light-detecting element, and a hose interconnecting the dust suction passage in the handle and the suction inlet of the main vacuum cleaner unit, the hose comprising outer and inner wound tapes and a core sandwiched between the outer and inner wound tapes, at least one of the outer and inner wound tapes being of a black or dark color.

The above and other objects, features and advantages of the present invention will become more apparent from the following description when taken in conjunction with the accompanying drawings in which preferred embodiments of the present invention are shown by way of illustrative example.

DETAILED DESCRIPTION

Figure 1:
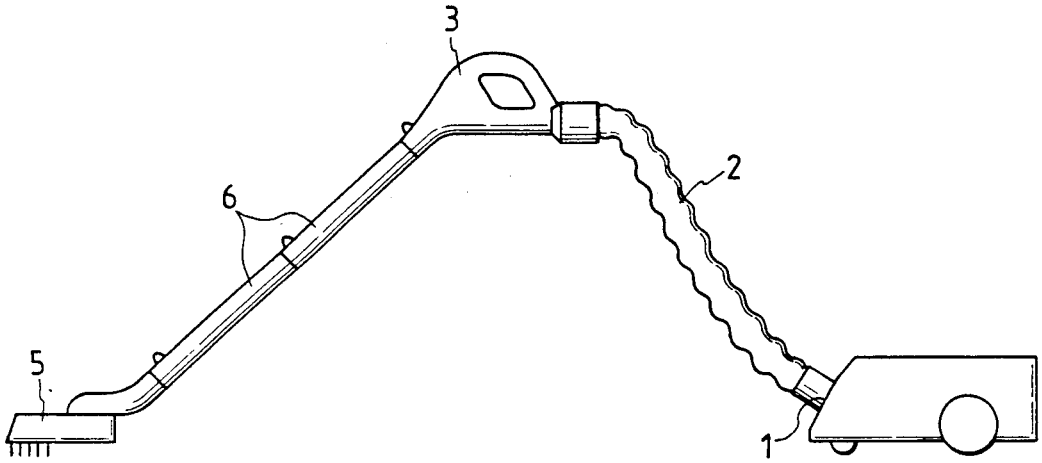
FIG. 1 is a side elevational view of a vacuum cleaner.

As shown in FIG. 1, a vacuum cleaner includes a main vacuum cleaner unit 1 movable on a floor and housing known mechanisms such as an air suction fan motor and a dust filter (not shown), a hose 2 connected at one end to an air inlet end of the main vacuum cleaner unit 1 and at the other end to a dust suction passage 4 (FIG. 2) defined in a handle 3, and a pipe 6 having one end connected to an upstream end of the dust suction passage 4 and the other end coupled to a floor nozzle 5.

Dust-laden air drawn by the floor nozzle 5 flows from the pipe 6 through the dust suction passage 4 in the handle 3 and the hose 2 into the filter in the main vacuum cleaner unit 1. Dust particles are trapped by the dust filter, and then clean air is discharged out of the main vacuum cleaner unit 1 by the fan motor.

Figure 2:
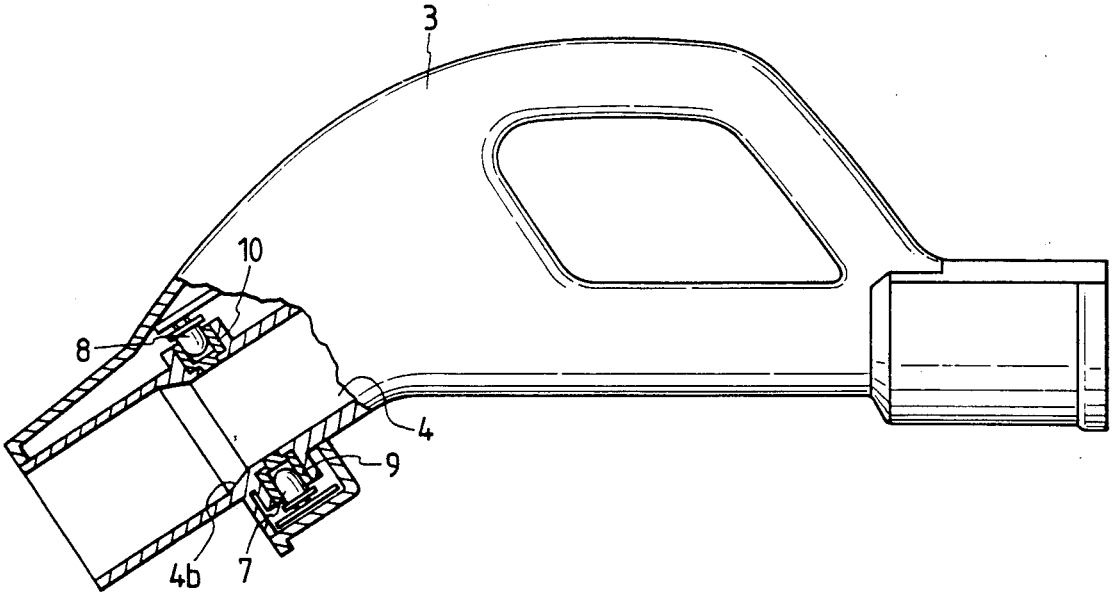
FIG. 2 is an enlarged side elevational view, partly in cross section, of a handle of the vacuum cleaner which incorporates a dust detector according to an embodiment of the present invention.
Figure 3:
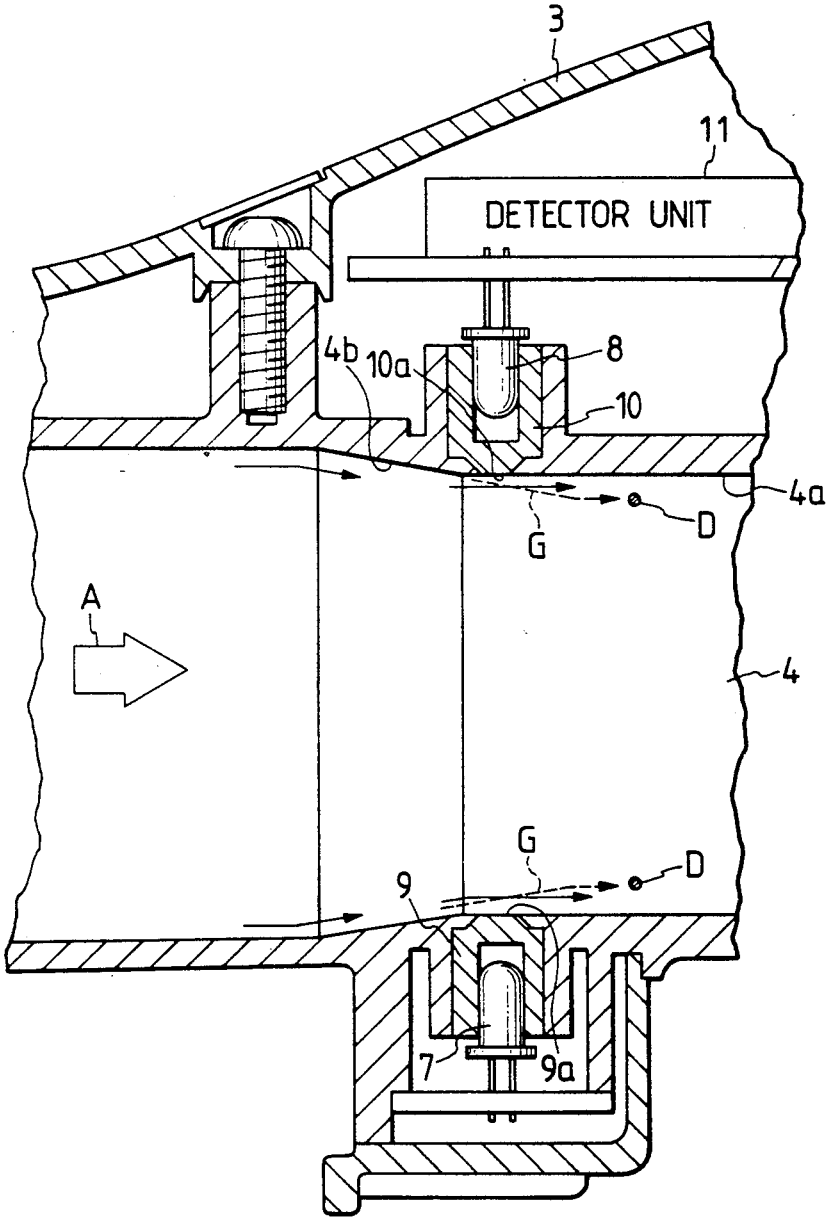
FIG. 3 is an enlarged fragmentary cross-sectional view of the dust detector.
Figure 4:
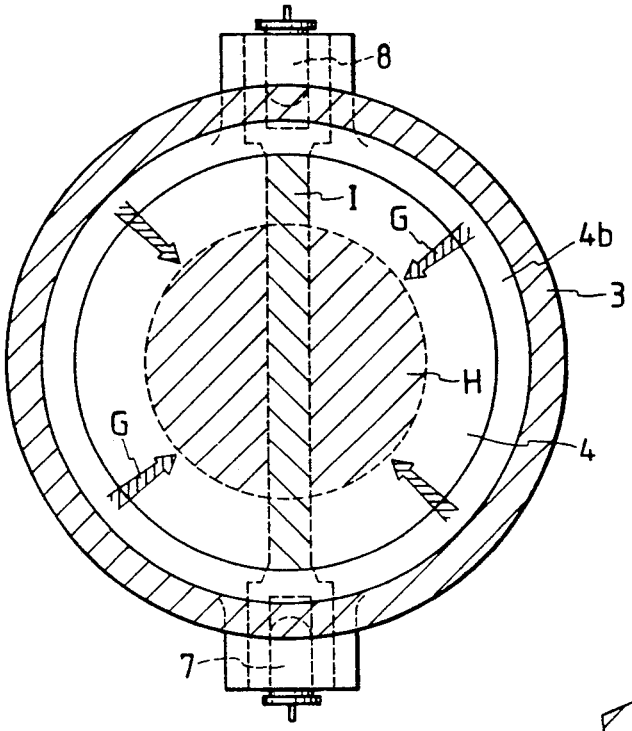
FIG. 4 is a transverse cross-sectional view of the dust detector.

A dust detector according to the present invention comprises a sensor disposed in the suction passage 4 in the handle 3. As shown in FIGS. 2, 3, and 4, the sensor comprises a light-emitting element 7 such as a light-emitting diode, for example, and a light-detecting element 8 such as a photodiode, for example. The light-emitting element 7 and the light-detecting element 8 are positioned on confronting walls across the suction passage 4. The light-emitting element 7 and the light-detecting element 8 are inserted respectively in cylindrical light-transmissive covers 9, 10 made of transparent synthetic resin such as acrylic resin. The confronting walls of the suction passage 4 have respective holes in which the respective light-transmissive covers 9, 10 are placed. The covers 9, 10 have distal ends near the suction passage 4, the distal ends having diameters equal to or smaller than the respective diameters of the light-emitting and -detecting elements 7, 8. The distal ends of the covers 9, 10 have end faces, i.e., a light-transmitting end face 9*a* and a light-receiving end face 10*a*, exposed into the suction passage 4 and lying flush with an inner wall surface 4*a* of the suction passage 4. The light-transmitting end face 9*a* and the light-receiving end face 10*a* are hardened by exposure to ultraviolet radiation.

The light-detecting element 8 is electrically connected to a detector unit 11 (FIG. 3) which converts the intensity of light that has been emitted from the light-emitting element 7 and reached the light-detecting element 8, to an electric signal. The detector unit 11 detects the quantity of dust flowing through the suction passage 4 based on the electric signal.

The dust detector operates as follows: The fan motor is energized to start drawing dust particles from the floor nozzle 5. The dust flows through the suction passage 4 as indicated by the arrow A. Light is emitted from the light-emitting element 7 and directed toward the light-detecting element 8. The greater the quantity of dust flowing through the suction passage 4, the lower the intensity of light that has reached the light-detecting element 8 because the transmittance of light across the suction passage 4 is lower. Therefore, the intensity of light detected by the light-detecting element 8 is lower as more dust particles flow through the suction passage 4. Based on a detected signal from the light-detecting element 8, the detector unit 11 detects the amount of dust flowing through the suction passage 4. Then, the detector unit 11 controls the rotational speed of the fan motor or the like based on the detected amount of dust. Some of the dust particles traveling through the suction passage 4 flow along the inner wall surface 4*a* of the suction passage 4. Since the end faces 9*a*, 10*a* of the light-transmissive covers 9, 10 lie flush with, or extend along, the inner wall surface 4*a*, the dust particles flow smoothly along the end faces 9*a*, 10*a* without turbulences which would otherwise be developed thereby. Accordingly, dust particles are not deposited on and near the end faces 9*a*, 1O*a* during operation of the vacuum cleaner.

More specifically, if the end faces 9*a*, 10*a* projected into the suction passage 4, they would not only obstruct the air flow through the suction passage 4 but also allow dust particles to impinge upon and be deposited on and around the end faces 9*a*, 10*a*. If the end faces 9*a*, 10*a* were recessed from the inner wall surface 4*a*, they would develop swirls to permit dust particles to be deposited on the end faces 9*a*, 10*b*. Therefore, the end faces 9*a*, 10*a* lying flush with the inner wall surface 4*a*as shown are effective to prevent dust particles from being deposited thereon.

The hardened end faces 9*a*, 1O*a* are highly resistant to damage even when they are hit by hard dust particles. Consequently, the end faces 9*a*, 10*a* transmit and receive light effectively without substantial intensity attenuation as they remain transparent.

As shown in FIG. 2, the dust sensor which is composed of the light-emitting element 7 and the light-detecting element 8 is positioned near the upstream end of the suction passage 4 which extends through the handle 3, i.e., near the end of the suction passage 4 which is connected to the pipe 6. Therefore, when the pipe 6 is detached from the handle 3, the end faces 9*a*, 10*a* of the covers 9, 10 can easily be cleaned by a piece of cloth, for example, inserted into the suction passage 4.

Each of the end faces 9*a*, 10*a* of the covers 9, 10 is smaller in diameter than the other portion of the cover. Light emitted from the light-emitting element 7 is shaped into a constant-diameter light beam by the reduced-diameter end face 9*a*, and the constant-diameter light beam is then transmitted from the end face 9*a* to the end face 1O*a*. Since the shaped constant-diameter light beam transmitted from the end face 9*a* to the end face 10*a* has a sharp boundary, the difference in light intensity between the light beam and a region surrounding the light beam is large, allowing accurate detection of a change in the light intensity which is caused by dust particles flowing across the light beam.

As shown in FIGS. 2 through 4, the inner wall surface 4*a* of the suction passage 4 has a conical taper surface 4*b* which is progressively smaller in diameter downstream 6 away from the end of the suction passage 4 to which the pipe is connected. The light-emitting element 7 and the light-detecting element 8 are positioned near the terminal end of the conical taper surface 4*b*.

Dust-laden air flowing through the suction passage 4 is directed obliquely inwardly toward the center of the suction passage 4 by the conical taper surface 4*b*. Therefore, dust particles D carried by the air flow are also oriented toward the center of the suction passage 4. The air flow itself tends to flow along the inner wall surface 4*a* due to the Coanda effect downstream of the terminal end of the conical taper surface 4*b*. However, the dust particles D which have a substantial weight as compared with air move owing to their inertia toward the center of the suction passage 4 as indicated by the arrows G. The dust particles D flowing along the inner wall surface 4*a* are thus forced away from the end faces 9*a*, 10*a* positioned downstream of the conical taper surface 4*b*, and are not attached to or deposited on the end faces 9*a*, 10*a*. The conical taper surface 4*b* offers another advantage. Inasmuch as the dust flow in the suction passage 4 downstream of the conical taper surface 4*b* is directed toward the center of the suction passage 4, the dust particles are concentrated into a shaded region H through which the light beam I is transmitted from the light-emitting element 7 to the light-detecting element 8. The concentrated dust particles can be detected by the light beam I with increased accuracy.

Figure 5:
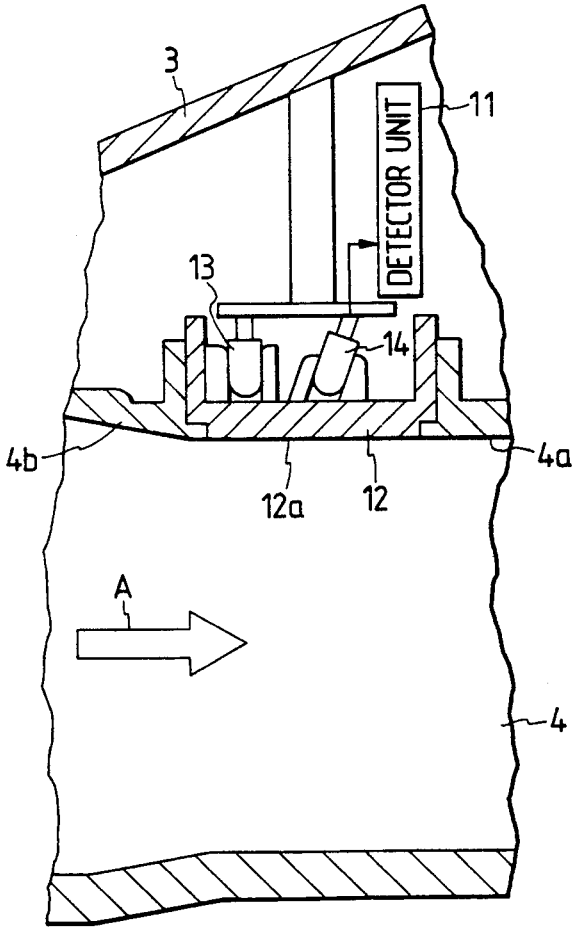
FIG. 5 is a fragmentary cross-sectional view of a dust detector according to another embodiment of the present invention.

FIG. 5 shows a dust detector according to another embodiment, the dust detector comprising a light-reflecting sensor.

As shown in FIG. 5, the light-reflecting sensor comprises a light-emitting element 13 and a light-detecting element 14 which are housed in a cylindrical light-transmissive cover 12 disposed in the wall of a suction passage 4 and having an end face 12*a* lying flush with an inner wall surface 4a of the suction passage 4. The light-emitting and -detecting elements 13, 14 have central axes inclined with respect to each other, or intersecting with each other, such that light emitted from the light-emitting element 13 is reflected by either a confronting area of the inner wall surface 4*a* or dust particles flowing through the suction passage 4, and detected by the light-detecting element 14.

Figure 6:
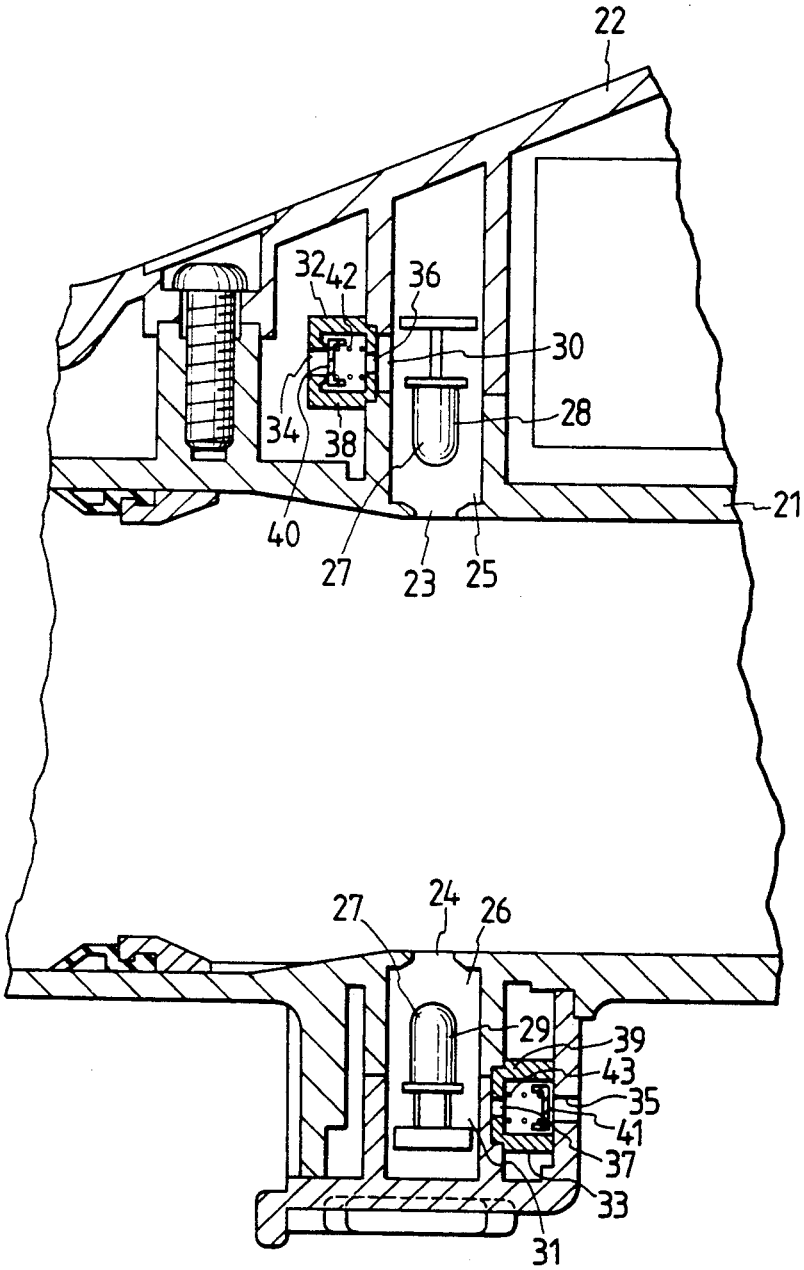
FIG. 6 is a fragmentary cross-sectional view of a dust detector according to still another embodiment of the present invention.
Figure 7:
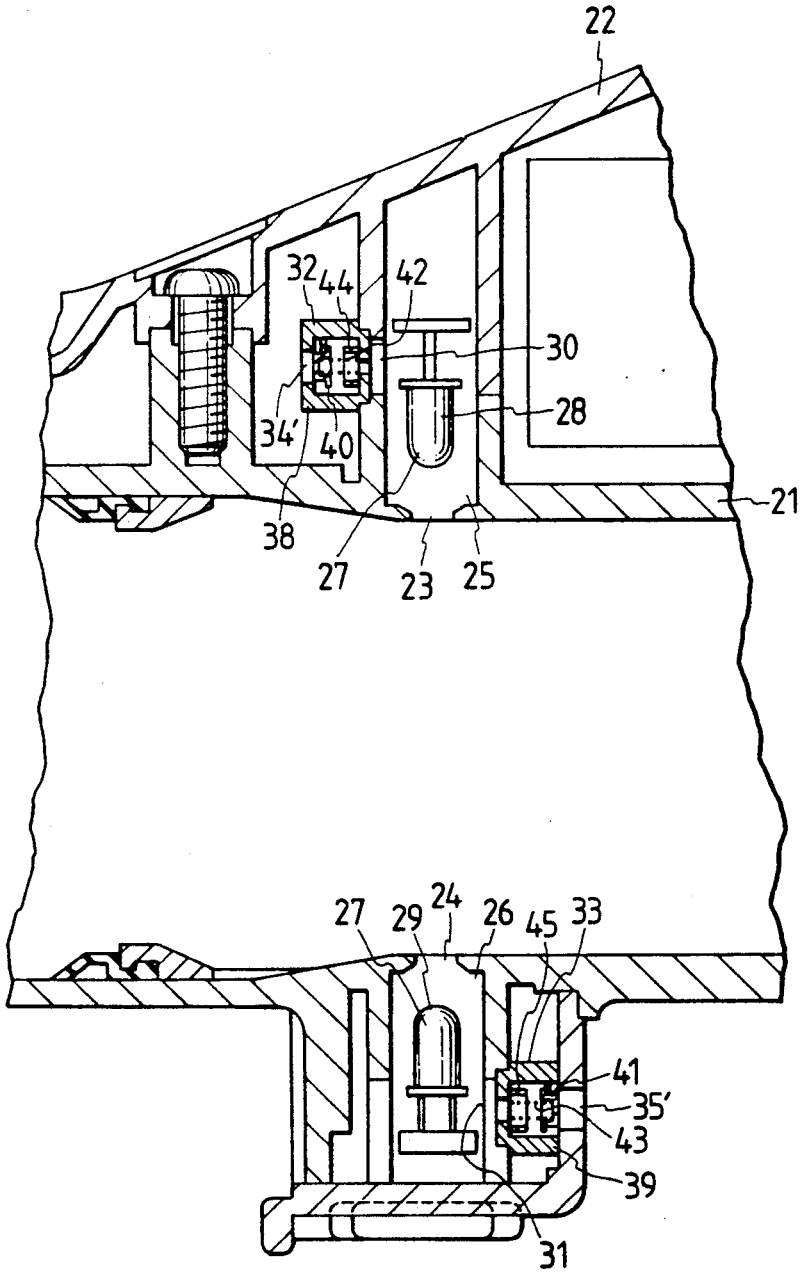
FIG. 7 is a fragmentary cross-sectional view of a dust detector according to yet another embodiment of the present invention.

FIGS. 6 and 7 illustrate dust detectors for vacuum cleaners according to other embodiments of the present invention, each having a means for introducing ambient air for cleaning light-emitting and -detecting elements.

In FIG. 6, a dust suction passage 21 is defined in and extends through a handle 22. A floor nozzle (not shown) is connected to the upstream end of the suction passage 21 through a pipe (not shown). The air inlet end of a main vacuum cleaner unit (not shown) is connected to the downstream end of the suction passage 21 through a hose (not shown).

The wall of the suction passage 21 has a pair of diametrically opposite openings or holes 23, 24 communicating respectively with element chambers 25, 26 defined in the suction passage wall. The dust detector comprises a sensor 27 composed of a light-emitting element 28 housed in the element chamber 25 and a light-detecting element 29 housed in the other element chamber 26. The intensity of light emitted from the light-emitting element 28 and detected by the light-detecting element 29 is varied depending on the amount of dust flowing through the suction passage 21 to vary an output signal from the light-detecting element 29.

The output signal from the light-detecting element 29 is then applied to a detector unit or control unit for controlling the rotational speed of the fan motor in the main vacuum cleaner unit or an indicator on the main vacuum cleaner unit. Air passages 30, 31 including the element chambers 25, 26 and the openings 23, 24 are defined in the wall of the suction passage 21 for introducing ambient air into the suction passage 21. Pressure-responsive valves 32, 33 are disposed in the air passages 30, 31, respectively. The pressure-responsive valves 32, 33 comprise valve casings 38, 39, respectively, having valve seats 34, 35, respectively, on upstream ends and holes 36, 37, respectively, in downstream ends, valve members 40, 41, respectively, for opening and closing the valve seats 34, 35 on their downstream sides, and springs 42, 43, respectively, for normally urging the valve members 40, 41 in a direction to close the valve seats 34, 35.

During normal cleaning operation of the vacuum cleaner, the vacuum pressure developed in the suction passage 21 falls within a prescribed range. The spring forces of the springs 42, 43 are selected so as not to open the valve members 40, 41 when the vacuum pressure in the suction passage 21 is in the prescribed range. Therefore, the air passages 30, 31 remain closed in the prescribed vacuum pressure range. When a surface which presents a large resistance to an air flow into the floor nozzle, such as a boarded floor, is cleaned, the pressure in the suction passage 21 is lowered by the resistance to the air flow. Therefore, the pressure difference across the valve members 40, 41 is increased to open the valve seats 34, 35 against the resiliency of the springs 42, 43.

Ambient air is now introduced through the air passages 30, 31 into the suction passage 21 to blow off dust particles that may have been deposited on the light-emitting and -detecting elements 28, 29.

The dust detector according to the yet other embodiment shown in FIG. 7 differs from the dust detector shown in FIG. 6 in that valve seats 44, 45 are provided respectively over the downstream holes 36, 37 and the casings 32, 33 have holes 34', 35' defined in their upstream ends, respectively. The springs 42, 43 have weaker spring forces selected such that when the pressure in the suction passage 21 is lower than a prescribed pressure level, the valve seats 44, 45 are closed by the valve members 40, 41 due to the difference between the vacuum pressure in the suction passage 21 and the atmospheric pressure.

When the floor nozzle is held against a surface being cleaned, it presents a resistance to an air flow into the floor nozzle, and the vacuum pressure in the suction passage 21 is lower than the prescribed pressure level. Therefore, the valve members 40, 41 close the valve seats 44, 45 against the bias of the springs 42, 43 due to the difference between the vacuum pressure in the suction passage 21 and the atmospheric pressure.

When the floor nozzle is lifted off the surface, then the resistance to the air flow into the floor nozzle is eliminated, increasing the pressure in the suction passage 21. The valve members 40, 41 are unseated off the valve seats 44, 45 by the springs 42, 43 to introduce ambient air through the air passages 30, 31 to clean the light-emitting and -detecting elements 28, 29.

In each of the embodiments shown in FIGS. 6 and 7, the air passages 30, 31 do not remain open at all times, but are opened at a selected time depending on a particular mode of use of the vacuum cleaner, for thereby introducing ambient air to clean the light-emitting and -detecting elements 28, 29. Therefore, the suction performance of the vacuum cleaner itself is maintained at a sufficient level.

Extraneous light tends to enter the suction passage 4 through the junction between the handle 3 and the pipe 6 (see FIG. 1). Extraneous light of a very low intensity level is also liable to pass through the hose 2 into the suction passage 4. Such extraneous light having entered suction passage 4 is responsible at times for triggering the dust sensor in error.

Figure 8:
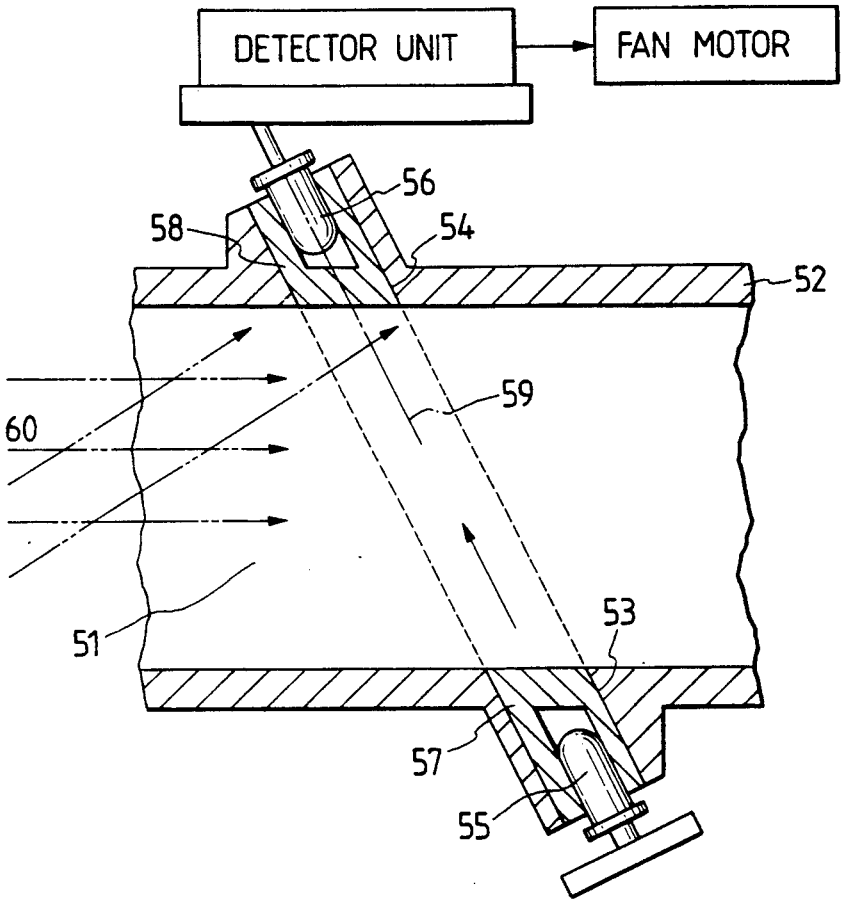
FIG. 8 is a fragmentary cross-sectional view of a dust detector according to still yet another embodiment of the present invention.
Figure 9:
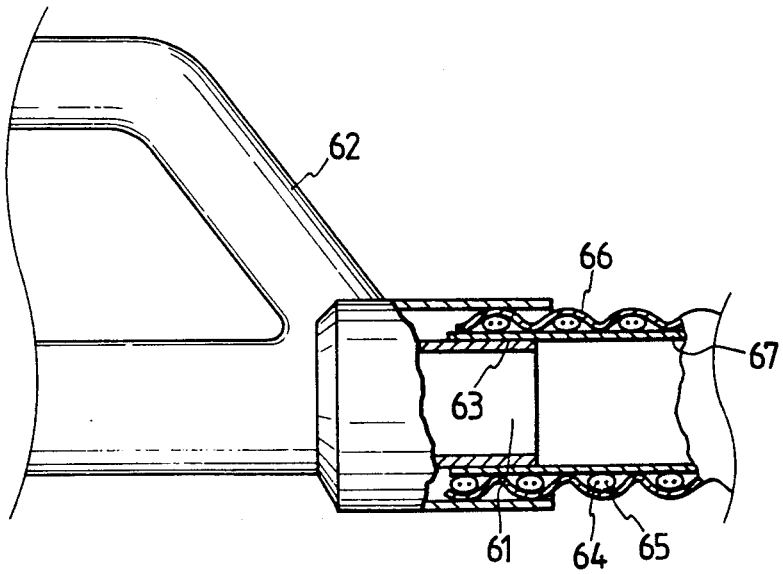
FIG. 9 is a side elevational view, partly in cross section, of a vacuum cleaner handle according to a further embodiment of the present invention.

FIGS. 8 and 9 show arrangements according to further embodiments of the present invention for preventing extraneous light from erroneously activating the dust sensor.

In FIG. 8, a dust suction passage 51 is defined in and extends through a handle 52. A floor nozzle (not shown) is connected to the upstream end of the suction passage 51 through a pipe (not shown). The air inlet end of a main vacuum cleaner unit (not shown) is connected to the downstream end of the suction passage 51 through a hose (not shown).

The wall of the suction passage 51 has a pair of opposite openings or holes 53, 54 defined near the upstream end of the suction passage 51 and confronting along a line inclined to the axis of the suction passage 51. A dust sensor comprises a light-emitting element 55 and a light-detecting element 56 disposed respectively in the openings 53, 54. The light-emitting and -detecting elements 55, 56 are covered respectively with light-transmissive covers 57, 58 made of acrylic resin or the like and having end faces exposed into the suction passage 51.

The light-detecting element 56 has its axis 59 extending obliquely downstream in the direction in which dust-laden air flows through the suction passage 51, the axis 59 being aligned with the axis of the light-emitting element 55.

When the fan motor in the main vacuum cleaner unit is energized, dust particles are drawn from the floor nozzle and flow through the suction passage 51. The greater the quantity of dust flowing through the suction passage 51, the lower the intensity of light that has been emitted from the light-emitting element 55 and has reached the light-detecting element 56. Therefore, the intensity of light detected by the light-detecting element 56 is lower as more dust particles flow through the suction passage 51. Based on a detected signal from the light-detecting element 56, a detector unit detects the amount of dust flowing through the suction passage 51, and controls the rotational speed of the fan motor or operates an indicator based on the detected amount of dust.

Rays 60 of extraneous light, if any, enter the suction passage 51 from its upstream end in the illustrated embodiment. Since the axis 59 of the light-detecting element 56 is inclined downstream in the direction of flow of dust-laden air through the suction passage 51, the extraneous light rays 60 do not reach the light-detecting element 56, which can thus detect light from the light-emitting element 55 with high accuracy without being effected by the extraneous light.

In the illustrated embodiment, the light-emitting and -detecting elements 55, 56 are disposed near the inlet end of the suction passage 51. However, if the light-emitting and -detecting elements are to be disposed near the outlet end of the suction passage, the axis of the light-detecting element should be inclined upstream in the direction of flow of dust-laden air. That is, the axis of the light-detecting element should be inclined in a direction opposite to the direction in which extraneous light enters the suction passage.

According to the further embodiment shown in FIG. 9, a dust suction passage 61 is defined in and extends through a handle 62. A floor nozzle (not shown) is connected to the upstream end of the suction passage 61 through a pipe (not shown). The air inlet end of a main vacuum cleaner unit (not shown) is connected to the downstream end of the suction passage 61 through a hose 63. The hose 63 comprises an outer wound tape 66 and an inner wound tape 67 with a piano wire 64 and an electrically conductive wire 65 being coiled and sandwiched between the outer and inner wound tapes 66, 67 to provide a core for keeping the hose 63 cylindrical in shape and flexible. At least one of the outer and inner wound tapes 66, 67 is of a black or dark color.

The suction passage 61 is defined by a cylindrical wall which is either molded of a synthetic resin containing an infrared radiation absorbent that is substantially incapable of transmitting or reflecting extraneous infrared radiation or coated with a black or dark color paint layer.

Infrared radiation emitted from a light-emitting element toward a light-detecting element of a dust sensor is cut off by dust particles flowing through the suction passage 61. Since extraneous infrared radiation does not reach the light-detecting element through the hose 63 or the wall of the suction passage 61, the sensitivity of the dust sensor may be increased to enable a dust detector comprising the dust sensor to detect small dust particles with high accuracy.

Although certain preferred embodiments have been shown and described, it should be understood that many changes and modifications may be made therein without departing from the scope of the appended claims.

What is claimed is:

1. A dust detector for a vacuum cleaner, comprising:

a dust suction passage for passing dust therethrough;

a light-emitting element for emitting light into said dust suction passage;

a light-emitting element cover disposed perpendicular to an axis of said dust suction passage for covering and holding in place said light-emitting element, said light-emitting element cover substantially enclosing said light-emitting element and being transmissive to said emitted light;

a light-emitting element cover end face exposed to said dust suction passage, said light-emitting element cover end face being flush with an inner wall surface of said dust suction passage and having a diameter equal to or less than the diameter of said light-emitting element;

a light-detecting element disposed to receive light emitted by said light-emitting element for detecting said light;

a light-detecting element cover disposed perpendicular to said axis of said dust suction passage for covering and holding in place said light-detecting element, said light-detecting element cover substantially enclosing said light-detector and being transmissive to said emitted light;

a light-detecting element cover end face exposed to said dust suction passage, said light-detecting element end face being flush with an inner wall surface of said dust suction passage and having a diameter equal to or less than the diameter of said light-detecting element; and a detector unit, coupled to said light-detecting element, for determining the amount of said dust passing through said dust suction passage, said detector unit being responsive to the intensity of light detected by said light-detecting element.

2. A dust detector according to claim 1, wherein said diameters of said end faces are such that said emitted light is collimated to a desired level.

3. A dust detector according to claim 1, wherein:

said light-emitting element and said light-detecting element are disposed opposite one another in said dust suction passage; and said element are in direct optical communication with one another.

4. A dust detector according to any one of claims 1–3, wherein:

said inner wall surface of said dust suction passage includes a taper surface becoming progressively smaller in diameter in a downstream direction with respect to a direction in which the dust passes through the dust suction passage;

said taper surface has a downstream terminal end; and said light-transmissive covers are disposed adjacent to and downstream of the terminal end of said taper surface.

5. A dust detector according to any one of claims 1–3 further comprising:

light absorbing material disposed proximate to said light-emitting element and said light-detecting element.

6. A dust detector according to claim 5, wherein said light-absorbing material is a black material.

7. A dust detector according to claim 5, wherein said light-absorbing material is infrared absorbent.

* * * * *

UNITED STATES PATENT AND TRADEMARK OFFICE

CERTIFICATE OF CORRECTION

PATENT NO. : 5,163,202

DATED : November 17, 1992

INVENTOR(S) : KAWAKAMI et al.

It is certified that error appears in the above-identified patent and that said Letters Patent is hereby corrected as shown below:

On the title page, Item [30]:
In "Foreign Application Priority Data",
First line, change "MAR. 24, 1988" to --AUG. 24, 1988--

Signed and Sealed this

Twenty-sixth Day of October, 1993

*Attest:*

*Attesting Officer*

Bruce Lehman

BRUCE LEHMAN

*Commissioner of Patents and Trademarks*